US009665112B2

(12) United States Patent
Singh et al.

(10) Patent No.: US 9,665,112 B2
(45) Date of Patent: May 30, 2017

(54) CIRCUITS AND TECHNIQUES INCLUDING CASCADED LDO REGULATION

(71) Applicant: Analog Devices Global, Hamilton (BM)

(72) Inventors: Amit Kumar Singh, Bangalore (IN); Nitish Kuttan, Bangalore (IN); Sriram Ganesan, Bangalore (IN)

(73) Assignee: Analog Devices Global, Hamilton (BM)

( * ) Notice: Subject to any disclaimer, the term of this patent is extended or adjusted under 35 U.S.C. 154(b) by 69 days.

(21) Appl. No.: 14/713,312

(22) Filed: May 15, 2015

(65) Prior Publication Data

US 2016/0334818 A1 Nov. 17, 2016

(51) Int. Cl.
*G05F 1/56* (2006.01)

(52) U.S. Cl.
CPC ..... *G05F 1/56* (2013.01)

(58) Field of Classification Search
CPC ..... G05F 1/56
See application file for complete search history.

(56) References Cited

U.S. PATENT DOCUMENTS 5,036,269 A * 7/1991 Murari ..... G05F 1/571 323/266
8,040,115 B2 * 10/2011 Egan ..... G05F 1/563 323/266
8,648,580 B2 2/2014 Wong
2007/0210779 A1 * 9/2007 Itoh ..... G05F 1/56 323/284
2010/0109435 A1 * 5/2010 Ahmadi ..... G05F 1/577 307/31
2010/0141223 A1 * 6/2010 Wadhwa ..... G05F 1/56 323/280
2011/0068758 A1 * 3/2011 Chiu ..... G05F 1/575 323/280

(Continued)

FOREIGN PATENT DOCUMENTS

CN 106155157 A 11/2016

OTHER PUBLICATIONS

Bu, Vincent L., "A CMOS Capacitor-Less Low Drop-Out Voltage Regulator", (2007), 5 pgs.

(Continued)

*Primary Examiner* — Jue Zhang
(74) *Attorney, Agent, or Firm* — Schwegman Lundberg & Woessner, P.A.

(57) ABSTRACT

A regulator circuit can include a cascaded topology, comprising a first integrated low-dropout (LDO) regulator circuit having a supply node, the first integrated LDO regulator circuit configured to provide a first loop bandwidth and configured to provide a regulated first output voltage to an intermediate node using energy provided by the supply node, and a second integrated LDO regulator circuit having an input coupled to the intermediate node, the second LDO regulator circuit configured to provide a second loop bandwidth and configured to provide a regulated second output voltage to an output node, where the second loop bandwidth is narrower than the first loop bandwidth. The regulator circuit need not require an external capacitor. The regulator circuit can be used to provide one or more of enhanced power supply rejection and noise performance.

19 Claims, 6 Drawing Sheets

(56) References Cited

U.S. PATENT DOCUMENTS

| | | | | |
|---|---|---|---|---|
| 2012/0086419 | A1* | 4/2012 | Bai | H04R 1/04 323/280 |
| 2014/0191739 | A1* | 7/2014 | Kim | G05F 1/575 323/280 |
| 2014/0266089 | A1* | 9/2014 | Pancholi | G05F 1/56 323/268 |

OTHER PUBLICATIONS

Gopalraju, Seenu, "An Off-Chip Capacitor Free Low Dropout Regulator with PSR enhancement at Higher Frequencies", (2010), 111 pgs.

Ha, Miranda J., "A Low-Power, High Bandwiidth LDO Voltage Regulator with No External Capacitor", (May 2008), 37 pgs.

Heinzer, Walt, "Powering Noise Sensitive Systems", Analog Devices / Avnet, (Nov. 11, 2013), 30 pgs.

Milliken, Robert J., "A Capacitor-Less Low Dropout Voltage Regulator with Fast Transient Reponse", (Dec. 2005), 106 pgs.

Morita, Glenn, "Noise Sources in Low Dropout (LDO) Regulators", Analog Devices, AN-1120 Application Note, (Jun. 23, 2011), 12 pgs.

Torres, Joselyn, et al., "Low Drop-Out Voltage Regulators: Capacitor-less Architecture Comparison", IEEE Circuits and Systems, (May 2014), 6-26.

Yang, Huan-Chien, et al., "High-PSR-Bandwidth Capacitor-Free LDO Regulator with 50uA Minimized Load Current Requirement for Achieving High Efficiency at Light Loads", WSEAS Transactions on Circuits and Systems, Issue 5 vol. 7, (May 2008), 10 pgs.

* cited by examiner

CIRCUITS AND TECHNIQUES INCLUDING CASCADED LDO REGULATION

BACKGROUND

Precision analog circuits and systems are generally supplied with operating energy from a power supply having stringent specifications regarding output noise and power supply rejection (PSR). A linear voltage regulator having low output noise and high PSR can be used, for example, and can be referred to as an LDO (low-dropout) regulator. According to various applications, an LDO regulator can be coupled to an energy source such as a battery or to an output of a switched-mode power supply (SMPS). An LDO implemented in an integrated circuit can use a discrete decoupling capacitor external to the integrated circuit to help meet an instantaneous load current demand of a load circuit that the LDO drives. Discrete capacitors can be used for other purposes, such as to help reduce noise at an output of a voltage reference circuit, where the voltage reference circuit is coupled to the LDO regulator.

OVERVIEW

The present inventors have recognized, among other things, that a low-dropout regulator circuit topology requiring an external capacitor can be unsuitable or undesirable in certain applications. For example, an LDO regulator circuit requiring an external capacitor generally consumes at least one extra pin on an integrated circuit package, adds to board area, and increases component and system cost by adding an additional component to the bill of materials. Bond wires used to electrically couple the external capacitor to an integrated circuit die can also provide a pathway to couple noise to the LDO circuit, which may degrade the noise performance at the output of the LDO regulator unacceptably for certain applications, such as those where the LDO regulator circuit is used to provide supply voltage to a precision analog circuit.

The present inventors have recognized, among other things, that a challenge can exist in meeting stringent power supply rejection (PSR) and output noise specifications for an LDO regulator while still eliminating a requirement for an external decoupling capacitor. Accordingly, in an example, the present inventors have developed circuits and techniques that can include using a cascaded configuration of LDO regulator circuits. Such a cascaded configuration can be used to provide a regulated output without requiring an external decoupling capacitor on an output of the cascaded LDO regulator circuits. A cascaded configuration can also permit a relaxed noise specification for one or more reference circuits coupled to the LDO regulators. In this manner, even where an external capacitor is omitted, such a cascaded configuration can also reduce an area requirement because any on-chip capacitor or RC filters can be correspondingly reduced in size. The present inventors have also recognized that a cascaded configuration can provide reduced power consumption as compared to other approaches, because such a cascaded configuration need not require loop bandwidths as wide as other approaches.

In an example, a regulator circuit can include a cascaded topology, comprising a first integrated low-dropout (LDO) regulator circuit having a supply node, the first integrated LDO regulator circuit configured to provide a first loop bandwidth and configured to provide a regulated first output voltage to an intermediate node using energy provided by the supply node, a second integrated LDO regulator circuit having an input coupled to the intermediate node, the second LDO regulator circuit configured to provide a second loop bandwidth and configured to provide a regulated second output voltage to an output node. In an example, the second loop bandwidth is narrower than the first loop bandwidth, and the first and second LDO regulator circuits are configured to provide a specified power supply rejection ratio (PSRR) and a specified output noise voltage density without requiring a discrete capacitor coupled to the output node external to an integrated circuit comprising the first and second integrated LDO regulators.

This overview is intended to provide an overview of subject matter of the present patent application. It is not intended to provide an exclusive or exhaustive explanation of the invention. The detailed description is included to provide further information about the present patent application.

Figure 1:
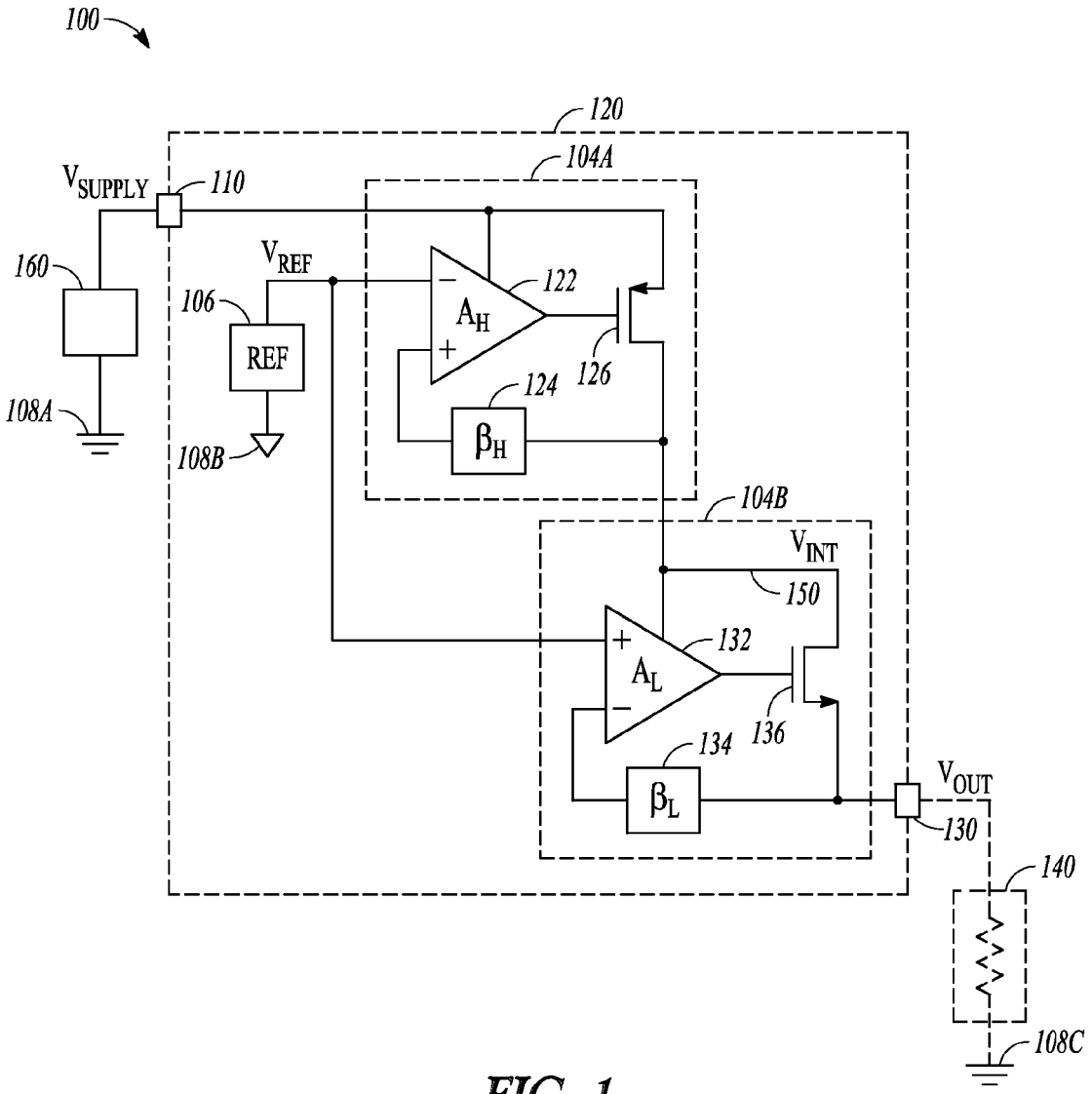
FIG. 1 illustrates generally an example showing a circuit topology that can include first and second low dropout (LDO) regulator circuits arranged in a cascaded configuration.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In one approach, to achieve high power supply rejection (PSR) from a regulator circuit, the regulator circuit loop bandwidth can be specified to be wide enough to suppress even high frequency noise from the power supply input (e.g., $V_{SUPPLY}$). However, as the noise specification for an output of the regulator circuit becomes more stringent, then a power consumption of the regulator increases considerably because of such wide loop bandwidth. Moreover, a complex frequency compensation scheme may be needed to ensure stability. By contrast with such an approach, a more power-efficient technique can include placing a large RC filter at the output of the regulator circuit to filter out the noise from the regulator. However, this approach can also have limitations because, for example, a series resistor included in such an RC circuit would generally cause the output voltage $V_{OUT}$ to vary unacceptably depending on load current. In yet another approach, an active low-pass filter arrangement can be used at the output of the regulator circuit. A bandwidth of an amplifier in the active low-pass filter circuit can be made small to achieve good filtering of even low frequency noise from the regulator circuit. But, such an active filtering approach can introduce a poorer PSR at the output due at least in part to a limited bandwidth of the low-pass filter (and such a filter is fed by the same supply node as the regulator circuit, unlike the topology 100 shown and described in relation to FIG. 1 and other examples herein).

FIG. 1 illustrates generally an example showing a circuit topology 100 that can include a first LDO regulator circuit 104A and a second LDO regulator circuit 104B arranged in a cascaded configuration, such as co-integrated as a portion of a commonly-shared integrated circuit 120. Each of the first and second LDO regulator circuits can include a feedback loop, as shown illustratively in the example of FIG. 1. A loop bandwidth of the first feedback loop provided by the first LDO regulator circuit 104A can be wider than a loop bandwidth of the second LDO regulator circuit 104B.

An energy source 160, such as a voltage source, can be coupled to a node $V_{SUPPLY}$ at a supply pin 110 of the integrated circuit. The source 160 can include a battery or other source of electrical energy. In an example, the source 160 can include a switched mode power supply (SMPS) or other circuit. The $V_{SUPPLY}$ node at pin 110 can be fed into the first LDO regulator circuit 104A. The first LDO regulator circuit 104A can then provide a regulated output at an intermediate node $V_{INT}$ 150.

The output at the intermediate node 150 can be fed as an input voltage into the second LDO regulator circuit 104B to power the second LDO regulator circuit 104B. The second LDO regulator circuit 104B can then provide an output $V_{OUT}$ at an output pin 130 of the integrated circuit 120.

The output pin 130 can be coupled to a load 140, such as a load including a precision analog circuit (e.g., a phase-locked-loop, a voltage-controlled oscillator, a low-noise amplifier, or a power amplifier, as illustrative examples). One or more reference nodes such as ground 108A or ground 108C can be coupled to the integrated circuit. Multiple ground domains can be provided. For example, a reference node 108B can be used internally within the integrated circuit 120. A voltage reference 106 can be included as a portion of the integrated circuit 120 (or coupled to the integrated circuit 120 via a reference input pin). The reference voltage $V_{REF}$ can be coupled to one or more of the first and second LDO regulator circuits 104A or 104B. In an example, the reference 106 is generated using a bandgap reference circuit.

The first LDO regulator circuit 104A can include a higher-bandwidth feedback loop than the second LDO regulator circuit 104B. The feedback structure of the first LDO regulator circuit 104A can include a first error amplifier 122 (having gain represented by $A_H$) having inputs coupled to the reference circuit 106 (e.g., a bandgap reference circuit) and a first feedback network 124 providing a feedback coefficient that can be represented by $\beta_H$. The output of the first error amplifier 122 can be coupled to a first pass transistor 126 (e.g., a positive-channel metal-oxide-semiconductor field-effect transistor (MOSFET) or "PMOS" device). An output of the first LDO circuit 104A can be represented by the node $V_{INT}$, and such a node can be provided as an input voltage to the second LDO circuit 104B, to power the second LDO circuit 104B as shown illustratively in FIG. 1. The second LDO circuit 104B can include a second error amplifier 132, such as having an input coupled to the reference circuit 106 or another reference, along with an input coupled to a second feedback network 134 providing a feedback coefficient that can be represented by $\beta_L$.

An output of the second error amplifier 132 can be coupled to a second pass transistor 136, (e.g., a negative-channel MOSFET or "NMOS" device), to provide an output voltage $V_{OUT}$ at a pin 130, to supply the load 140 (e.g., a precision analog circuit). The conductivity types of the first and second pass transistors 126 and 136 are illustrative, and such transistors 126 and 136 can include other conductivity types or structures. In FIG. 1, the first and second transistors 126 and 136 have opposite conductivity types. In an example, the second pass transistor 136 can include a "native" N-channel device or other device configuration, such as having a reduced or near-zero threshold voltage, where the native device is co-integrated within the integrated circuit 120 along with other portions of the circuit topology 100. Such a native device can reduce a voltage drop through the first and second LDO regulator circuits 104A and 104B.

A unity-gain bandwidth of the first LDO regulator circuit 104A can include a first specified frequency that is higher than a unity gain bandwidth of the second LDO regulator circuit 104B. As an illustrative example, a loop gain of the first LDO regulator circuit 104A can be greater in magnitude than unity in a specified range of frequencies, such as from about 10 kilohertz (KHz) to about 10 megahertz (MHz), and a loop gain of the second LDO regulator circuit 104B can be less in magnitude than unity the specified range of frequencies from about 10 KHz to about 10 MHz. The combination of a cascaded architecture, including a higher-bandwidth first LDO regulator circuit 104A and lower-bandwidth second LDO regulator circuit 104B, where the second LDO regulator circuit is powered by the output $V_{INT}$ of the first regulator circuit, can be used to meet one or more of a stringent PSR or noise specification without requiring capacitors external to the integrated circuit 120.

Without being bound by theory, the topology 100 can be used for applications supplying precision analog loads. Such loads can be relatively constant (e.g., presenting a substantially static current draw). The topology 100 is not generally focused on handling large transients, however the topology 100 can be combined with other techniques such including use of auxiliary loops to improve transient performance. Also, as mentioned above, a native device can be used for the second pass transistor 136, which can help to reduce output impedance, improving transient performance.

Figure 2:
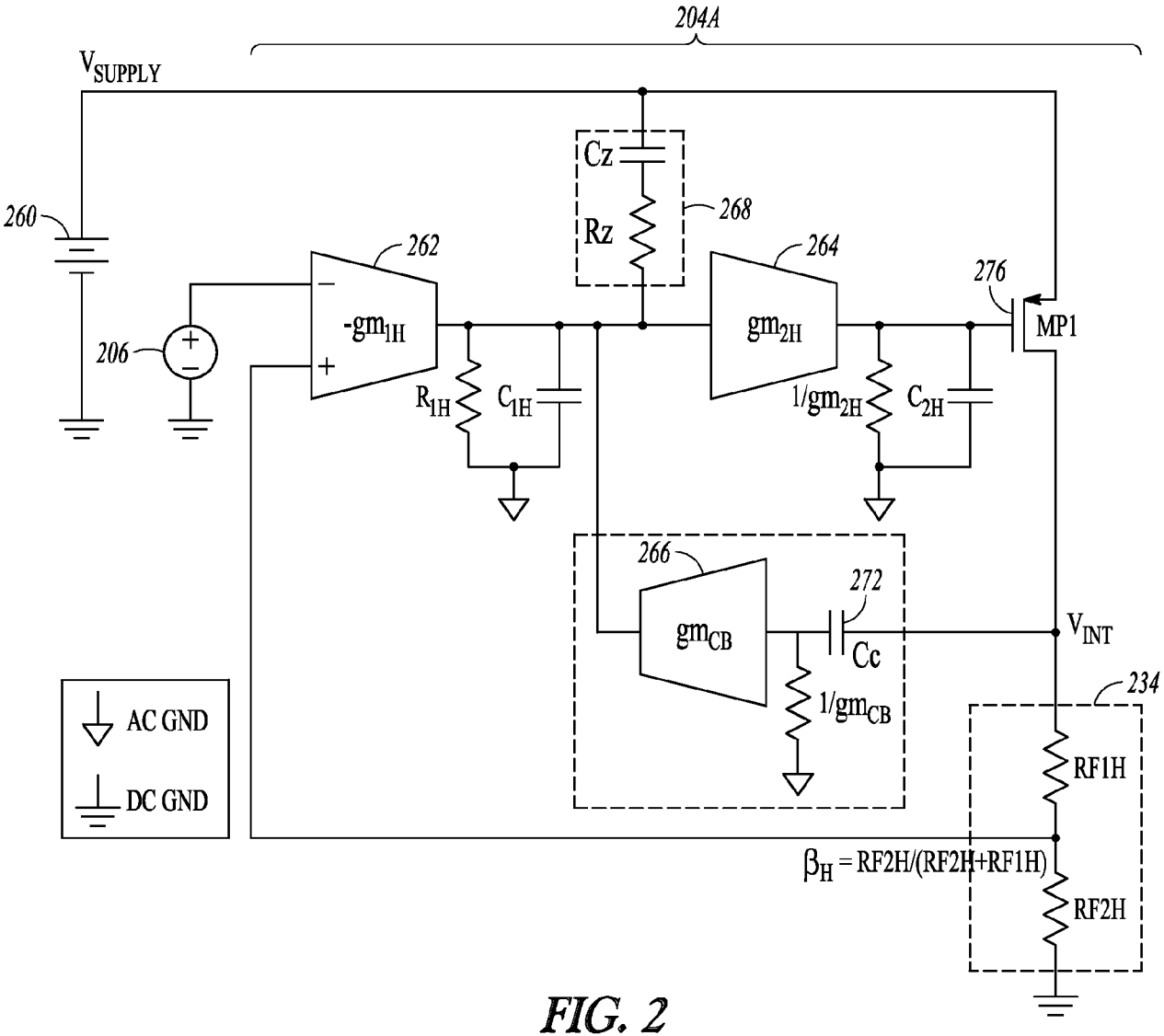
FIG. 2 illustrates generally an example showing a circuit topology that can include an LDO regulator circuit, such as can be included as a portion of the cascaded topology shown in the example of FIG. 1 or described elsewhere herein.

FIG. 2 illustrates generally an example showing a circuit topology 204A that can include an LDO regulator circuit, such as can be included as a portion of the cascaded topology shown in the example of FIG. 1 or described elsewhere herein. For example, the topology 204A can be used to implement the first LDO regulator circuit 104A of FIG. 1. A source 260 (e.g., a battery or SMPS output) can provide a supply voltage, VSUPPLY. The regulator circuit can include a first transconductance amplifier stage 262, a second buffer stage 264, and a current buffer stage 266. An output of the second buffer stage 264 can be coupled to a pass transistor 276, to establish an output voltage VINT. A feedback network 234 can couple the VINT node to an input of the first transconductance stage 262, and a voltage reference 206 (e.g., a bandgap circuit) can be coupled to a second input of the first transconductance stage 262.

The first transconductance stage 262 can be implemented as a portion of a folded cascode topology. The transconductance can be represented as $gm_{1H}$. $R_{1H}$ and $C_{1H}$ can represent an output impedance and capacitance of the first transconductance stage 262. The current buffer stage 266 can provide a transconductance $gm_{CB}$, such as representing the cascode devices of the folded cascode topology. The current buffer stage 266 together with a compensation capacitor $C_c$ can form a cascode compensation scheme. An additional zero (formed by a network 268, including $R_z$ and $C_z$, can be included at an output of the first transconductance stage 262 to improve phase margin. The buffer stage 264 can include a transconductance represented by $gm_{2H}$, and having an output impedance $1/gm_{2H}$ and output capacitance represented by $C_{2H}$. The second buffer stage 264 can drive a gate of a PMOS power device (e.g., pass transistor 276), and a gate-to-source capacitance of the pass transistor 276 can be represented by $C_{gs}$, which dominates $C_{2H}$. The pass transistor 276 device together with the resistive divider network (e.g., feedback network 234) forms the third stage of the regulator circuit topology 204A.

For the cascode compensation scheme, a dominant pole location can be represented approximately by, $$Pdom = \frac{1}{gm_{PH} R_{PH} Cc R_{1H}} \quad \text{[EQN. 1]}$$

where $gm_{PH}$ and $R_{PH}$ can represent the transconductance and output impedance of the pass transistor 276 stage in parallel with (RF1H+RF2H) respectively. The non-dominant poles (damping factor (ζ) and natural frequency (ωn)) and zeros introduced by the cascode compensation scheme can be expressed as follows.

Non-Dominant Poles:

$$\varsigma = \frac{1}{2}\sqrt{\frac{gm_{CB} C_{1H}}{gm_{PH} C_{PH}}} \cdot \left(1 + \frac{C_{PH}}{Cc}\right); \omega n = \sqrt{\frac{gm_{CB} gm_{PH}}{C_{PH} C_{1H}}} \quad \text{[EQN. 2]}$$

Zeros:

$$Z1, 2 = \pm\sqrt{\frac{gm_{CB} gm_{PH}}{Cc C_{1H}}} \quad \text{[EQN. 3]}$$

The series resistor, $R_z$, and capacitor, $C_z$, can introduce a zero close to a unity-gain bandwidth (UGB) frequency, such as to improve stability (and a non-dominant pole can be introduced, which is far beyond the UGB frequency). As an illustrative example, $V_{SUPPLY}$ can be selected from a range of about 2.2V to about 3.6V, $V_{REF}$ can be specified to be about 1.2V, and $V_{INT}$ can be specified to be about 2V.

Figure 3:
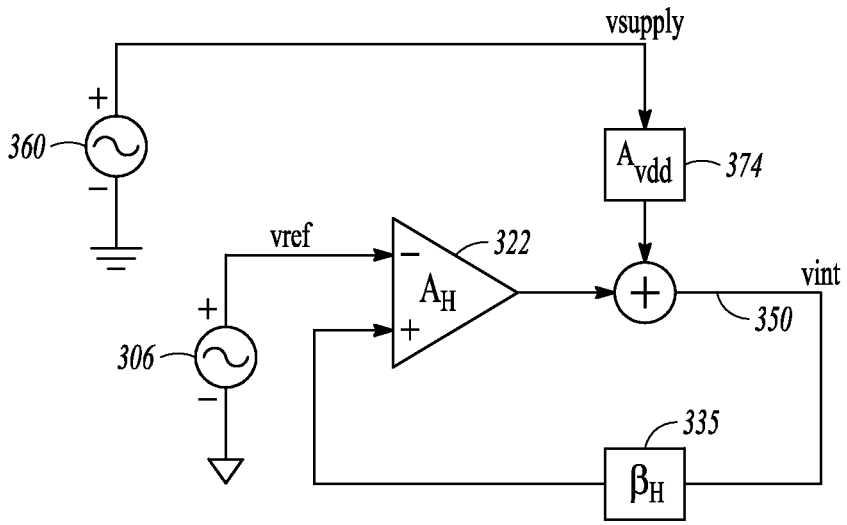
FIG. 3 illustrates generally an example that can include an equivalent circuit topology that can be used such as to illustrate PSR performance of the circuit topology shown in the example of FIG. 2.

FIG. 3 illustrates generally an example that can include an equivalent circuit topology that can be used such as to illustrate power supply rejection (PSR) performance of the circuit topology 204A shown in the example of FIG. 2. In FIG. 3, $A_H$ can represent an open loop feedforward gain 322 of this regulator, $\beta_H$ can represent a feedback factor 335, $A_{vdd}$ can represent an open loop gain from a supply node provided by source 360 to an output node vint 350 (e.g., where the source 360 corresponds to a power supply signal contribution for purposes of power supply rejection analysis), vref can represent the noise from a reference 306 output, vsupply can represent the supply noise at LDO circuit power input rail.

The supply noise at the output of this regulator can be expressed as follows:

$$vint(j\omega) = \frac{A_H(j\omega)}{1 + A_H(j\omega)\beta_H(j\omega)} vref(j\omega) + \frac{A_{vdd}(j\omega)}{1 + A_H(j\omega)\beta_H(j\omega)} vsupply(j\omega) \quad \text{[EQN. 4]}$$

FIG. 3 can model PSR of a first, higher-bandwidth, LDO regulator circuit included in a cascaded scheme. The first higher-bandwidth LDO regulator circuit can be configured to suppress or reduce supply noise coupled from a $V_{SUPPLY}$ node to the $V_{INT}$ node (e.g., improving VSUPPLY to VINT rejection). The first term in EQN. 4 can represent noise generated by or associated with the reference, $V_{REF}$, and such noise can be suppressed or reduced by the second LDO regulator circuit having lower bandwidth (e.g., the second LDO circuit 104B or 404B of FIG. 1 or 4) as compared to the first LDO regulator circuit. The vref term can be ignored in the analysis related to FIG. 3 and can be addressed in the example of FIGS. 4 and 5, below. Accordingly, vint can be simplified as follows:

$$vint(j\omega) = \frac{A_{vdd}(j\omega)}{1 + A_H(j\omega)\beta_H(j\omega)} vsupply(j\omega) \quad \text{[EQN. 5]}$$

Power supply rejection can then be defined as follows:

$$PSR \triangleq \frac{vsupply(j\omega)}{vint(j\omega)} = \frac{1 + A_H(j\omega)\beta_H(j\omega)}{A_{vdd}(j\omega)} \quad \text{[EQN. 6]}$$

A bandwidth of the first LDO regulator circuit can be specified to be much higher than the second LDO regulator circuit, such as to provide sufficient gain across a specified range of frequencies to suppress supply ripple sufficiently at the $V_{INT}$ (intermediate) output. Such a specified range of frequencies can include a bandwidth into the MHz region, as an illustrative example.

Figure 4:
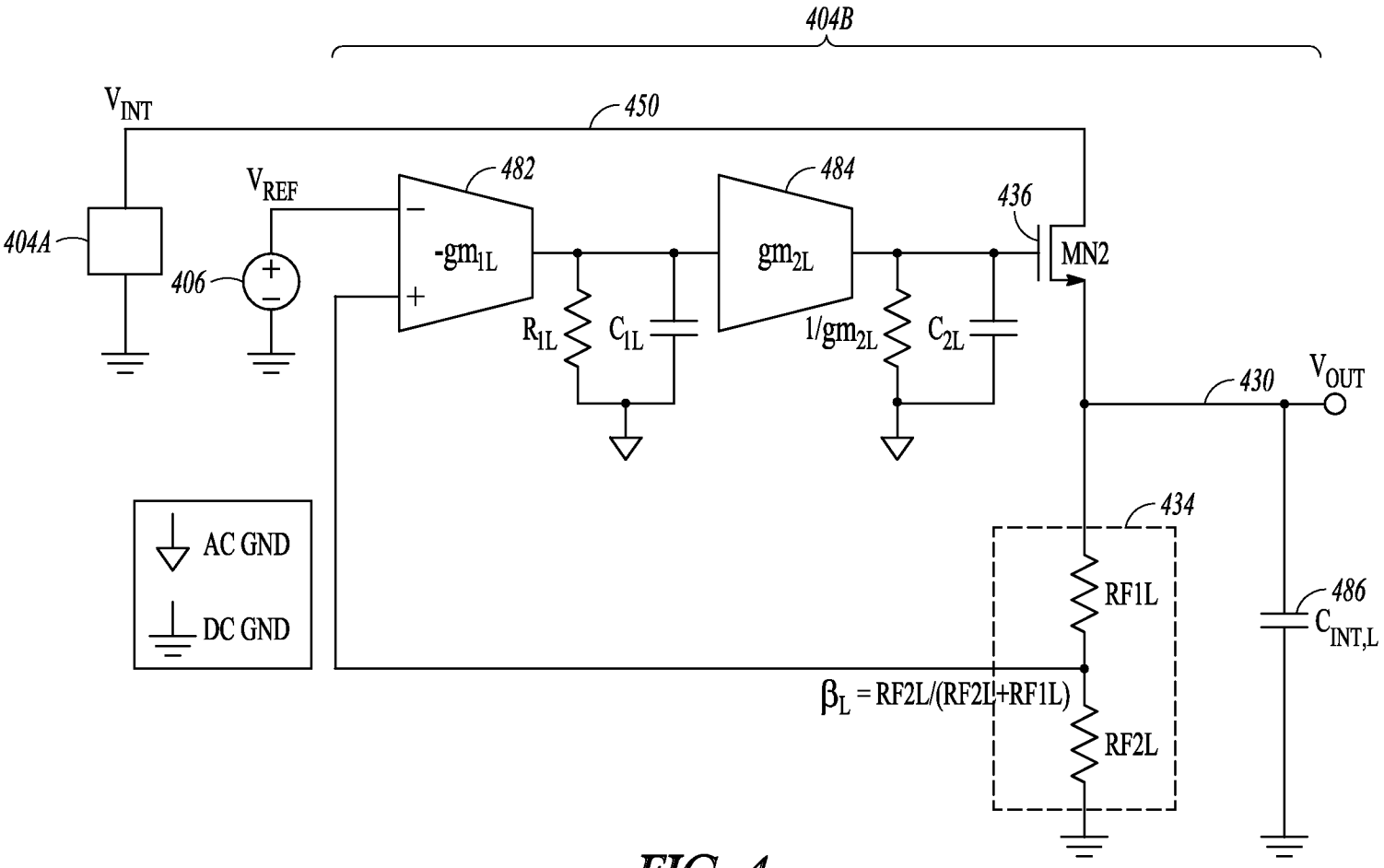
FIG. 4 illustrates generally an example showing a circuit topology that can include an LDO regulator circuit, such as can be included as a portion of the cascaded topology shown in the example of FIG. 1 or described elsewhere herein.

FIG. 4 illustrates generally an example showing a circuit topology 404B that can include an LDO regulator circuit, such as can be included as a portion of the cascaded topology shown in the example of FIG. 1 or described elsewhere herein. As shown illustratively in FIG. 4, the circuit topology 404B can be coupled to an output node VINT 450 of a first LDO regulator circuit 404A (e.g., where the first LDO regulator circuit 404A can include a topology similar to the topology 204A of FIG. 2). The circuit topology 404B can thereby provide a second LDO regulator circuit supplied by the first LDO regulator circuit 404A. The topology 404B of FIG. 4 includes three stages including first and second stages comprising a first differential transconductance amplifier stage 482 coupled to a buffer circuit 484. The third stage can be provided by the output transistor MN2 436, such as can include a native NMOS transistor. A feedback network 434 can provide a feedback factor that can be represented as $\beta_L$. The first differential gain stage 482 can include a transconductance represented as $gm_{1L}$, an output impedance represented as $R_{1L}$, and a capacitance $C_{1L}$. The capacitance $C_{1L}$ can also represent an integrated capacitor located at an output of the first stage, and such an integrated capacitor can dominate a value of $C_{1L}$. Inputs of the differential transconductance stage 482 can be coupled to a reference circuit 406 (e.g., a bandgap reference), and the feedback network 434, respectively.

Figure 5:
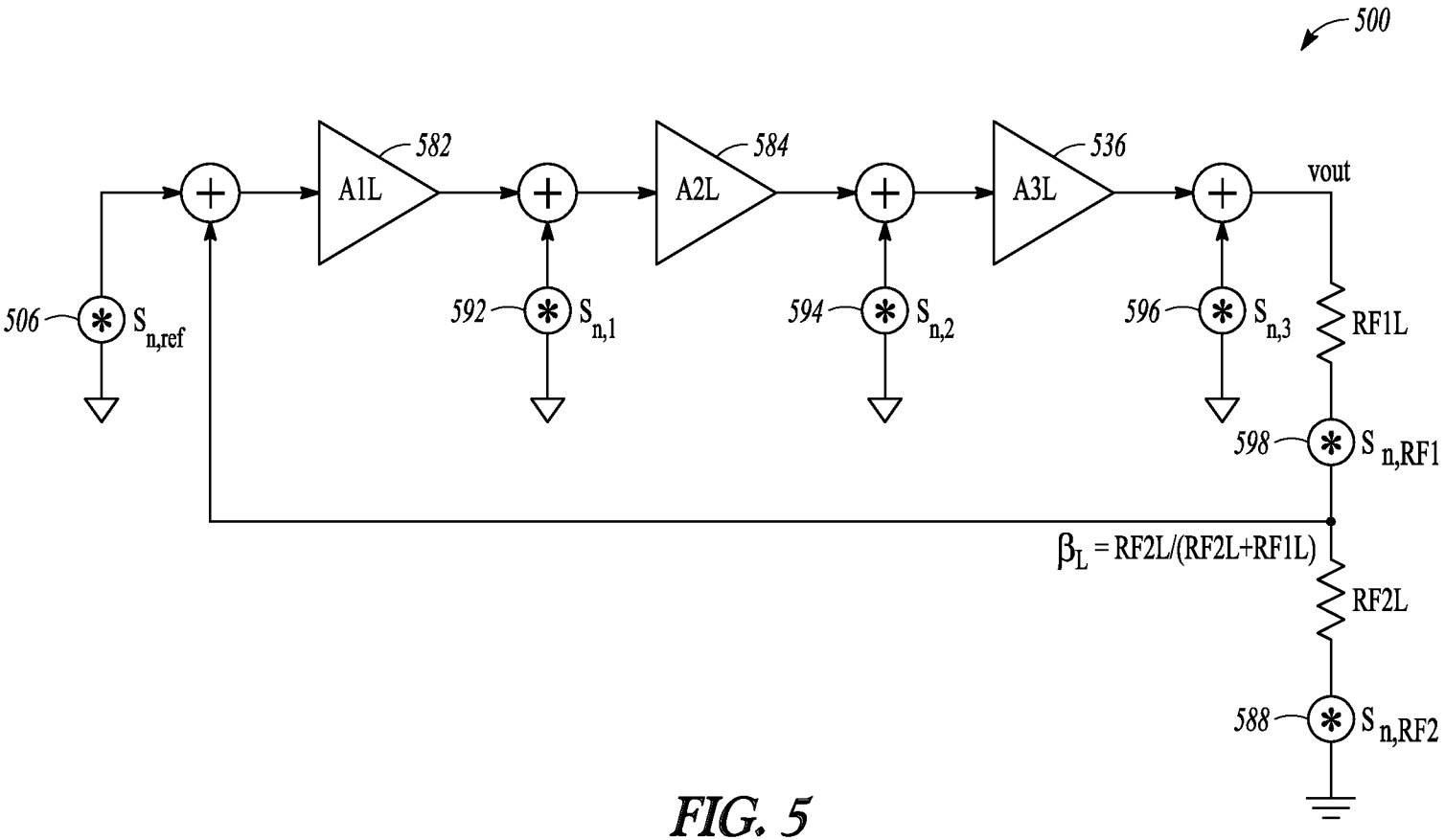
FIG. 5 illustrates generally an example that can include an equivalent circuit topology that can be used such as to illustrate noise performance of the circuit topology shown in the example of FIG. 4.

A power spectral density (PSD) at the output node 430 ($V_{OUT}$) can be represented as a sum of PSDs for each of the stages 482, 484, and 436, with the gain factors of each stage represented as amplifier stages 582, 584, and 536, as shown and described in relation to the analysis shown in FIG. 5. Referring back to FIG. 4, a bandwidth of the first stage 482 can be controlled, such as to provide a low bandwidth relative to a bandwidth of the LDO topology 204A of FIG. 2. For example, a bandwidth of the first stage 482 can be established by one or more of bias current control (e.g., reducing bias current to reduce bandwidth) or increasing output capacitance $C_{1L}$. In the illustrative example of FIG. 4, a dominant pole compensation scheme can be used, such as using $C_{1L}$ and $R_{1L}$ to set a location of the dominant pole frequency.

In an example, the buffer stage 484 can include a PMOS source follower, having transconductance, output impedance, and capacitance represented by $gm_{2L}$, $1/gm_{2L}$, and $C_{2L}$, respectively. An integrated capacitor can be coupled to the output of the buffer second stage 484, such as to dominant a total capacitance $C_{2L}$ at the output. Because a bandwidth of the LDO circuit topology 404B can be limited as compared to the LDO circuit 404A feeding the LDO circuit topology 404B, the capacitance $C_{2L}$ along with a gate-to-drain capacitance, $C_{gd}$, of the power device forms a capacitive divider beyond a unity-gain bandwidth (UGB) of the circuit topology 404B. Such a bandwidth can be around 1 KHz or a few KHz, according to illustrative examples. The capacitive divider can further enhance PSR in addition to the PSR performance of the higher-bandwidth LDO regulator 404A that can be used to feed the circuit topology 404B. Even though $C_{2L}$ can represent an intentional (rather than exclusively parasitic) capacitor, a pole formed by the second stage 484 can be located beyond UGB (e.g., where such UGB is established by gm1L and C1L), such as due to the low output impedance of the second stage 484.

As mentioned above, the third stage can include a power transistor 636 (e.g., a MOS device such as forming an NMOS source follower. Because the configuration shown in FIG. 4 does not require a decoupling capacitor external to an integrated circuit including the regulator circuit topology 404B, a lower impedance output stage can be used to reduce any instantaneous dips caused when the load is first applied or when the load changes abruptly. Because the second and third stages (e.g., buffer circuit 484 and transistor 436) form source follower circuits, such source follower circuits generally have lower output impedance and hence lower noise voltage than other circuit configurations. To assist in improving transient performance, an internal integrated decoupling capacitor $C_{int,L}$ can be included, such as close to an output pin or close to a load circuit if the load (e.g., a VCO) is co-integrated with the cascaded LDO circuits 404A and 404B. The integrated decoupling capacitor is generally orders of magnitude smaller in capacitance than a discrete external capacitor, however the cascaded configuration of LDO circuits 404A and 404B can still provide PSR performance comparable or exceeding performance of circuits that require a bulk decoupling capacitor external to the integrated circuit.

FIG. 5 illustrates generally an example that can include an equivalent circuit topology that can be used such as to illustrate noise performance of the circuit topology 404B shown in the example of FIG. 4. For the analysis below, each of the amplifier stages of the topology 404B can be represented by amplifier stages 582, 584, and 536 having voltage gains A1L, A2L and A3L, respectively. Noise sources can be used to represent output noise power spectral densities (PSDs) of a reference circuit noise 506 $S_{n,ref}$, first stage output noise 592 $S_{n,1}$, second stage output noise 594 $S_{n,2}$, and third stage output noise 596 $S_{n,3}$, along with noise sources 598 $S_{n,RF1}$ and 588 $S_{n,RF2}$, corresponding to the feedback resistors RF1L and RF2L, respectively.

For uncorrelated noise sources, a total output noise PSD can be obtained by adding the contribution of each component as shown below:

$$S_{n,out}(f) = S_{n,ref}(f)\left(\frac{A1L^2A2L^2A3L^2}{1+\beta^2A1L^2A2L^2A3L^2}\right) + S_{n,1}(f)\left(\frac{A2L^2A3L^2}{1+\beta^2A1L^2A2L^2A3L^2}\right) + S_{n,2}(f)\left(\frac{A3L^2}{1+\beta^2A1L^2A2L^2A3L^2}\right) + S_{n,3}(f)\left(\frac{1}{1+\beta^2A1L^2A2L^2A3L^2}\right) + S_{n,RF1}(f) + S_{n,RF2}(f)\left(\frac{RF1L^2}{RF2L^2}\right) \quad \text{[EQN. 7]}$$

If the first stage 582 has a limited bandwidth, the first gain term A1L approaches zero at frequencies of interest (such as beyond about 10 KHz). The present inventors have recognized that such low pass filtering can suppress or eliminate reference circuit noise 506. In this manner, a noise specification of the reference circuit can be relaxed, which can provide one or more of power or area savings. Accordingly, the total output noise PSD can be simplified as follows:

$$S_{n,out}(f) = S_{n,1}(f)(A2L^2A3L^2) + S_{n,2}(f)(A3L^2) + S_{n,3}(f) + S_{n,RF1}(f) + S_{n,RF2}(f)\left(\frac{RF1L^2}{RF2L^2}\right) \quad \text{[EQN. 8]}$$

Because the second and third stages can be implemented as follower stages, such follower stages have unity gain, their noise contribution is low, and the following relationship can be established:

$$S_{n,out}(f) \leq S_{n,1}(f) + S_{n,2}(f) + S_{n,3}(f) + S_{n,RF1}(f) + S_{n,RF2}(f)\left(\frac{RF1L^2}{FR2L^2}\right) \quad \text{[EQN. 9]}$$

Each of the above PSD components represents the noise of each stage filtered by the stage impedance and capacitance and can be expressed as follows:

$$S_{n,1}(f) = \frac{16KT(gm1Li + gm1Ll)}{3\left(4\pi^2C_{lL}^2f^2 + \frac{1}{R_{1l}^2}\right)} \quad \text{[EQN. 10]}$$

In EQN. 10, gm1Li and gm1L1 can represent transconductances of input and load device of the first amplifier stage A1L. A low noise PSD can be achieved for such as by one or more of reducing bandwidth (e.g., as controlled by bias current) or filtering action through an intentional capacitor $C_{1L}$. Because the second and third stages can be implemented as follower stages, their respective noise PSDs can be limited in magnitude as compared to the first stage, and such noise PSDs of the second and third stages can be represented by the following relationships:

$$S_{n,2}(f) = \frac{8KT}{3gm_{2L}\left(4\pi^2 C_{2L}^2 f^2 \frac{1}{gm_{2L}^2} + 1\right)} \quad \text{[EQN. 11]}$$

$$S_{n,3}(f) = \frac{8KT}{3gm_{3L}\left(4\pi^2 C_{int,L}^2 f^2 \frac{1}{gm_{3L}^2} + 1\right)} \quad \text{[EQN. 12]}$$

Noise contributions from the feedback resistors can be represented as shown below in EQNS. 13 and 14, and a noise contribution from such feedback resistors can be controlled using an internal decoupling capacitor $C_{int,L}$:

$$S_{n,RF1} = \frac{4KTRF1L}{(4\pi^2 C_{int,L}^2 f^2 RF1L^2 + 1)} \quad \text{[EQN. 13]}$$

$$S_{n,RF2} = \frac{4KTRF2L}{(4\pi^2 C_{int,L}^2 f^2 RF2L^2 + 1)} \quad \text{[EQN. 14]}$$

The analysis shown in the models corresponding to FIGS. 3 and 5 can be combined to form a PSR representation for a cascaded configuration of LDO regulator circuits. Such a combined PSR representation can be expressed as follows, where EQN. 15 represents a noise representation for the first regulator, and EQN. 16 represents a noise representation for the second regulator:

$$vint(j\omega) = \frac{A_H(j\omega)}{1 + A_H(j\omega)\beta_H(j\omega)} vref(j\omega) + \frac{A_{vdd,H}(j\omega)}{1 + A_H(j\omega)\beta_H(j\omega)} vsupply(j\omega) \quad \text{[EQN. 15]}$$

$$vout(j\omega) = \frac{A_L(j\omega)}{1 + A_L(j\omega)\beta_L(j\omega)} vref(j\omega) + \frac{A_{vdd,L}(j\omega)}{1 + A_L(j\omega)\beta_L(j\omega)} vint(j\omega) \quad \text{[EQN. 16]}$$

Accordingly, an overall PSR can be expressed as shown in EQNS. 17 and 18:

$$vout(j\omega) = \frac{A_L(j\omega)}{1 + A_L(j\omega)\beta_L(j\omega)} vref(j\omega) + \frac{A_{vdd,L}(j\omega)}{1 + A_L(j\omega)\beta_L(j\omega)} \left\{ \frac{A_H(j\omega)}{1 + A_H(j\omega)\beta_H(j\omega)} vref(j\omega) + \frac{A_{vdd,H}(j\omega)}{1 + A_H(j\omega)\beta_H(j\omega)} vsupply(j\omega) \right\} \quad \text{[EQN. 17]}$$

$$vout(j\omega) = vref(j\omega)\left\{ \frac{A_L(j\omega)}{1 + A_L(j\omega)\beta_L(j\omega)} + \left(\frac{A_{vdd,L}(j\omega)}{1 + A_L(j\omega)\beta_L(j\omega)}\right)\left(\frac{A_H(j\omega)}{1 + A_H(j\omega)\beta_H(j\omega)}\right)\right\} + vsupply(j\omega)\left\{\left(\frac{A_{vdd,H}(j\omega)}{1 + A_H(j\omega)\beta_H(j\omega)}\right)\left(\frac{A_{vdd,L}(j\omega)}{1 + A_L(j\omega)\beta_L(j\omega)}\right)\right\} \quad \text{[EQN. 18]}$$

As mentioned in relation to other examples herein, the cascaded LDO regulator circuits can have different loop bandwidths, such as where a first LDO regulator circuit has a higher loop bandwidth relative to a second LDO regulator circuit fed by an output of the first LDO regulator circuit. For example, in a specified range of frequencies, such as a range between about 10 KHz to about 10 10 MHz, $A_H$ can be much greater than unity in magnitude and $A_L$ can be much less than unity in magnitude. Accordingly, the expression of EQN 18 can be further simplified as shown in EQN. 19:

$$vout(j\omega) = vref(j\omega)\left\{(A_{vdd,L}(j\omega))\left(\frac{1}{\beta_H(j\omega)}\right)\right\} + vsupply(j\omega)\left\{\left(\frac{A_{vdd,H}(j\omega)}{A_H(j\omega)\beta_H(j\omega)}\right)(A_{vdd,L}(j\omega))\right\} \quad \text{[EQN. 19]}$$

Because the second LDO regulator circuit can have a much more limited bandwidth as compared to the first LDO regulator circuit, the term $$\frac{A_L(j\omega)}{1 + A_L(j\omega)\beta_L(j\omega)}$$

can become negligible in the vref-to-vout transfer function. Also, as mentioned above in relation to the example of FIG. 4, the intentional capacitor dominating $C_{2L}$ at the second stage of the lower-bandwidth regulator (e.g., the second LDO regulator circuit in the cascaded configuration) can form a capacitive divider with gate-to-drain capacitance $C_{gd}$ of a power output FET. In an example where such a capacitive divider exists, the term $A_{vdd,L}(j\omega)$ can be approximately expressed as $$\frac{Cgd}{C2L}$$

in a range of frequencies beyond the UGB of the lower-bandwidth regulator. Accordingly, a noise gain corresponding to the voltage reference can be further suppressed by such capacitive division, and a PSR specification of the reference circuit can thereby be relaxed by such a ratio $$\frac{Cgd}{C2L}.$$

Figure 6:
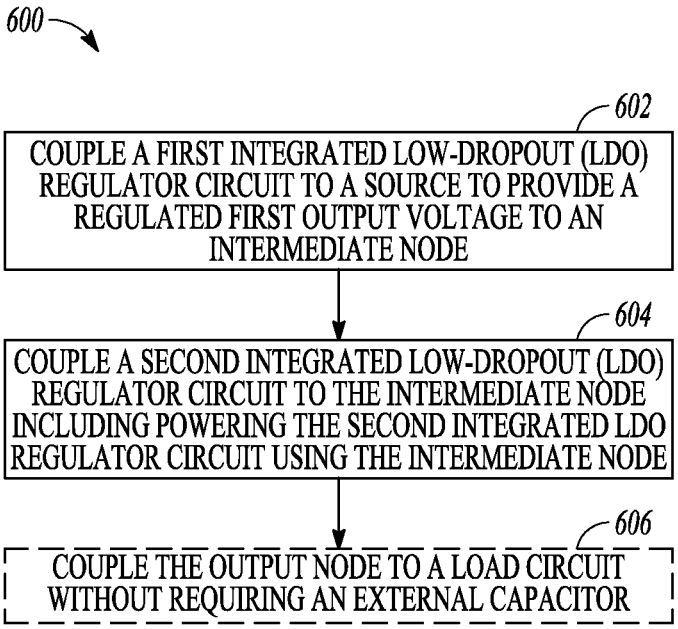
FIG. 6 illustrates generally a technique, such as a method, that can include coupling a first and second LDO regulator circuits in a cascaded configuration, and coupling an output of the second LDO regulator circuit to a load.

FIG. 6 illustrates generally a technique 600, such as a method, that can include coupling a first and second LDO regulator circuits in a cascaded configuration, and coupling an output of the second LDO regulator circuit to a load. At 602, a first LDO regulator circuit can be coupled to a source, such as a batter or an output of a switched-mode powers supply (SMPS). The first LDO regulator circuit can provide a first regulated output voltage to an intermediate node (e.g., such as can be represented by $V_{INT}$). A loop gain of the first LDO regulator circuit can be much greater in magnitude than unity within a specified frequency range. Such a frequency range can extend into a range of MHz or tens of MHz, according to various illustrative examples. At 604, a second LDO regulator circuit can be coupled to the intermediate node, such as powered by the intermediate node. The second LDO regulator circuit can provide a regulated second output voltage to an output node (e.g., $V_{OUT}$). A loop gain of the second LDO regulator circuit can be different from the first LDO regulator circuit, such as less in magnitude than unity in the specified frequency range. For example, the second LDO regulator circuit can have a unity-gain bandwidth extending to a KHz, a few KHz, or a few tens of KHz, according to various illustrative examples.

At 606, the output node of the second LDO regulator circuit can be coupled to a load, such as a precision analog load, such as including one or more of a phase-locked-loop, a voltage-controlled oscillator, a low-noise amplifier, or a power amplifier. Such a load can include circuitry separate from an integrated circuit comprising the first and second LDO regulator circuits. Alternative, or in addition, the load can include circuitry co-integrated with the first and second LDO regulator circuits. In an example, a voltage reference (e.g., a bandgap reference) can be co-integrated with the first and second LDO regulator circuits, or the reference can be separate from the first and second LDO regulator circuits. In the various examples mentioned above, the cascaded configuration of first and second LDO circuits need not require a capacitor external to the integrated circuit or circuits coupled to the output of the second LDO regulator circuit.

VARIOUS NOTES & EXAMPLES

Example 1 can include or use subject matter (such as an apparatus, a method, a means for performing acts, or a device readable medium including instructions that, when performed by the device, can cause the device to perform acts), such as can include or use a regulator circuit having a cascaded topology, comprising a first integrated low-dropout (LDO) regulator circuit having a supply node, the first integrated LDO regulator circuit configured to provide a first loop bandwidth and configured to provide a regulated first output voltage to an intermediate node using energy provided by the supply node, and a second integrated LDO regulator circuit having an input coupled to the intermediate node, the second LDO regulator circuit configured to provide a second loop bandwidth and configured to provide a regulated second output voltage to an output node. The second loop bandwidth is narrower than the first loop bandwidth and the first and second LDO regulator circuits are configured to provide a specified power supply rejection ratio (PSRR) and a specified output noise voltage density without requiring a discrete capacitor coupled to the output node external to an integrated circuit comprising the first and second integrated LDO regulators.

Example 2 can include, or can optionally be combined with the subject matter of Example 1, to optionally include that a loop gain of the first integrated LDO regulator circuit is much higher than unity in a specified frequency range, and that a loop gain of the second integrated LDO regulator circuit is much lower than unity in the specified frequency range.

Example 3 can include, or can optionally be combined with the subject matter of one or any combination of Examples 1 or 2 to optionally include that the first and second integrated LDO regulator circuits each comprise an error amplifier coupled to a pass transistor.

Example 4 can include, or can optionally be combined with the subject matter of Example 3, to optionally include that the pass transistor of the first integrated LDO regulator includes a first conductivity type, and that the pass transistor of the second integrated LDO regulator circuit includes an opposite second conductivity type.

Example 5 can include, or can optionally be combined with the subject matter of Example 4, to optionally include that the pass transistor of the first integrated LDO regulator includes a PMOS device, and that the pass transistor of the second integrated LDO regulator circuit includes an NMOS device.

Example 6 can include, or can optionally be combined with the subject matter of Example 5, to optionally include that the NMOS device comprises a native device.

Example 7 can include, or can optionally be combined with the subject matter of one or any combination of Examples 1 through 4 to optionally include that the first integrated LDO regulator circuit comprises a folded cascode stage and a buffer stage coupled between the folded cascode stage and the integrated pass transistor.

Example 8 can include, or can optionally be combined with the subject matter of Example 7, to optionally include a series RC network configured to provide a zero near a frequency corresponding to a unity gain bandwidth of the first integrated LDO regulator circuit.

Example 9 can include, or can optionally be combined with the subject matter of one or any combination of Examples 7 or 8 to optionally include that the folded cascode stage comprises at least one compensating capacitor coupled to a current buffer, the current buffer comprising a portion of the folded cascode stage.

Example 10 can include, or can optionally be combined with the subject matter of one or any combination of Examples 1 through 9 to optionally include that the second integrated LDO comprises a differential transconductance stage and a source follower stage with transconductance, the source follower stage coupled between the differential transconductance stage and the pass transistor.

Example 11 can include, or can optionally be combined with the subject matter of one or any combination of Examples 1 through 10 to optionally include that the output of the second integrated LDO regulator circuit is coupled to an integrated decoupling capacitor.

Example 12 can include, or can optionally be combined with the subject matter of one or any combination of Examples 1 through 11 to optionally include that the first and second LDO regulator circuits are coupled to a voltage reference, and a noise specification and power supply rejection specification of the voltage reference are relaxed as compared to a regulator circuit configuration lacking a cascaded configuration of the first and second LDO regulator circuits and lacking the second loop bandwidth narrower than the first loop bandwidth.

Example 13 can include, or can optionally be combined with the subject matter of one or any combination of Examples 1 through 12 to optionally include that the first and second LDO regulator circuits are configured to provide the specified PSRR and the specified output noise voltage density when driving a load circuit comprising one or more of a phase-locked-loop, a voltage-controlled oscillator, a low-noise amplifier, or a power amplifier.

Example 14 can include, or can optionally be combined with the subject matter of one or any combination of Examples 1 through 13 to include, subject matter (such as an apparatus, a method, a means for performing acts, or a machine readable medium including instructions that, when performed by the machine, that can cause the machine to perform acts), such as can include a regulator circuit having a cascaded topology, comprising a first integrated low-dropout (LDO) regulator circuit having a supply node, the first integrated LDO regulator circuit configured to provide a first loop bandwidth and configured to provide a regulated first output voltage to an intermediate node using energy provided by the supply node, and a second integrated LDO regulator circuit having an input coupled to the intermediate node, the second LDO regulator circuit configured to provide a second loop bandwidth and configured to provide a regulated second output voltage to an output node. The second loop bandwidth is narrower than the first loop bandwidth, and the first and second LDO regulator circuits are configured to provide a specified power supply rejection ratio (PSRR) and a specified output noise voltage density without requiring a discrete capacitor coupled to the output node external to an integrated circuit comprising the first and second integrated LDO regulators. The pass transistor of the first integrated LDO regulator includes a PMOS device, and the pass transistor of the second integrated LDO regulator circuit includes an NMOS device.

Example 15 can include, or can optionally be combined with the subject matter of Example 14, to optionally include a loop gain of the first integrated LDO regulator circuit that is greater in magnitude than unity in a frequency range from about 10 kilohertz (kHz) to about 10 megahertz (MHz), a loop gain of the second integrated LDO regulator circuit is much less in magnitude than unity in the frequency range from about 10 kHz to about 10 MHz.

Example 16 can include, or can optionally be combined with the subject matter of one or any combination of Examples 14 or 15 to optionally include that the NMOS device comprises a native device.

Example 17 can include, or can optionally be combined with the subject matter of one or any combination of Examples 1 through 16 to include, subject matter (such as an apparatus, a method, a means for performing acts, or a machine readable medium including instructions that, when performed by the machine, that can cause the machine to perform acts), such as can include coupling a first integrated low-dropout (LDO) regulator circuit to a source to provide a regulated first output voltage to an intermediate node using a loop gain much greater in magnitude than unity in a specified frequency range, and coupling a second integrated LDO regulator circuit to the intermediate node, including powering the second integrated LDO regulator circuit using the intermediate node, to provide a regulated second output voltage to an output node using a loop gain much less in magnitude than unity in the specified frequency range.

Example 18 can include, or can optionally be combined with the subject matter of Example 17, to optionally include coupling the output node to a load circuit without requiring an external capacitor.

Example 19 can include, or can optionally be combined with the subject matter of Example 18, to optionally include that the load circuit comprises one or more of a phase-locked-loop, a voltage-controlled oscillator, a low-noise amplifier, or a power amplifier.

Example 20 can include, or can optionally be combined with the subject matter of one or any combination of Examples 17 through 19 to optionally include that the first and second LDO regulator circuits are configured to provide a specified power supply rejection ratio (PSRR) and a specified output noise voltage density without requiring a discrete capacitor coupled to the output node external to an integrated circuit comprising the first and second integrated LDO regulators.

Example 21 can include, or can optionally be combined with any portion or combination of any portions of any one or more of Examples 1 through 20 to include, subject matter that can include means for performing any one or more of the functions of Examples 1 through 20, or a machine-readable medium including instructions that, when performed by a machine, cause the machine to perform any one or more of the functions of Examples 1 through 20.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

Use of the phrase "MOS," MOSFET," "PMOS," or "NMOS" does not imply or require that such devices must include a metal layer or metal gate. Instead, such devices can include a conductive gate structure or other conductive layers such as can include polysilicon or other materials.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A regulator circuit having a cascaded topology, comprising:

a first integrated low-dropout (LDO) regulator circuit having a supply node, the first integrated LDO regulator circuit configured to provide a first loop bandwidth and, using a loop gain much greater in magnitude than unity in a specified frequency range from about 10 kilohertz (kHz) to about 10 megahertz (MHz), configured to provide a regulated first output voltage to an intermediate node using energy provided by the supply node; and a second integrated LDO regulator circuit having an input coupled to the intermediate node, the second LDO regulator circuit configured to provide a different second loop bandwidth and, using a loop gain much less in magnitude than unity in the specified frequency range from about 10 kilohertz (kHz) to about 10 megahertz (MHz), configured to provide a regulated second output voltage to an output node.

2. The regulator circuit of claim 1, wherein the first and second integrated LDO regulator circuits each comprise an error amplifier coupled to a pass transistor.

3. The regulator circuit of claim 2, wherein the pass transistor of the first integrated LDO regulator includes a first conductivity type; and wherein the pass transistor of the second integrated LDO regulator circuit includes an opposite second conductivity type.

4. The regulator circuit of claim 3, wherein the pass transistor of the first integrated LDO regulator includes a PMOS device; and wherein the pass transistor of the second integrated LDO regulator circuit includes an NMOS device.

5. The regulator circuit of claim 3, wherein the NMOS device comprises a native device.

6. The regulator circuit of claim 1, wherein the first integrated LDO regulator circuit comprises:

a folded cascode stage; and a buffer stage coupled between the folded cascode stage and the integrated pass transistor.

7. The regulator circuit of claim 6, comprising a series RC network configured to provide a zero near a frequency corresponding to a unity gain bandwidth of the first integrated LDO regulator circuit.

8. The regulator circuit of claim 6, wherein the folded cascode stage comprises at least one compensating capacitor coupled to a current buffer, the current buffer comprising a portion of the folded cascode stage.

9. The regulator circuit of claim 1, wherein the second integrated LDO comprises a differential transconductance stage; and a source follower stage with transconductance, the source follower stage coupled between the differential transconductance stage and the pass transistor.

10. The regulator circuit of claim 1, wherein the output of the second integrated LDO regulator circuit is coupled to an integrated decoupling capacitor.

11. The regulator circuit of claim 1, wherein the first and second LDO regulator circuits are coupled to a voltage reference; and wherein a device noise specification and power supply rejection specification of the voltage reference are relaxed as compared to a regulator circuit configuration lacking a cascaded configuration of the first and second LDO regulator circuits, lacking a loop gain of the first LDO regulator circuit having a magnitude much greater than unity in the specified frequency range, and lacking a loop gain of the second LDO regulator circuit having a magnitude much less in magnitude than unity in the specified frequency range.

12. The regulator circuit of claim 1, wherein the first and second LDO regulator circuits are configured to provide a specified PSRR and a specified output noise voltage density when driving a load circuit comprising one or more of a phase-locked-loop, a voltage-controlled oscillator, a low-noise amplifier, or a power amplifier without requiring a discrete capacitor coupled to the output node external to an integrated circuit comprising the first and second integrated LDO regulators.

13. A regulator circuit having a cascaded topology, comprising:

a first integrated low-dropout (LDO) regulator circuit having a supply node, the first integrated LDO regulator circuit configured to provide a first loop bandwidth and, using a loop gain much greater in magnitude than unity in a specified frequency range from about 10 kilohertz (kHz) to about 10 megahertz (MHz), configured to provide a regulated first output voltage to an intermediate node using energy provided by the supply node; and a second integrated LDO regulator circuit having an input coupled to the intermediate node, the second LDO regulator circuit configured to provide a second loop bandwidth and, using a loop gain much less in magnitude than unity in the specified frequency range from about 10 kilohertz (kHz) to about 10 megahertz (MHz), configured to provide a regulated second output voltage to an output node;

wherein the second loop bandwidth is narrower than the first loop bandwidth; and wherein the first and second LDO regulator circuits are configured to provide a specified power supply rejection ratio (PSRR) and a specified output noise voltage density without requiring a discrete capacitor coupled to the output node external to an integrated circuit comprising the first and second integrated LDO regulators;

wherein the pass transistor of the first integrated LDO regulator includes a PMOS device; and wherein the pass transistor of the second integrated LDO regulator circuit includes an NMOS device.

14. The regulator circuit of claim 13, wherein the NMOS device comprises a native device.

15. A method, comprising:

coupling a first integrated low-dropout (LDO) regulator circuit to a source to provide a regulated first output voltage to an intermediate node using a loop gain much greater in magnitude than unity in a specified frequency range; and coupling a second integrated LDO regulator circuit to the intermediate node, including powering the second integrated LDO regulator circuit using the intermediate node, to provide a regulated second output voltage to an output node using a loop gain much less in magnitude than unity in the specified frequency range.

16. The method of claim 15, comprising coupling the output node to a load circuit without requiring an external capacitor.

17. The method of claim 16, wherein the load circuit comprises one or more of a phase-locked-loop, a voltage-controlled oscillator, a low-noise amplifier, or a power amplifier.

18. The method of claim 15, wherein the first and second LDO regulator circuits are configured to provide a specified power supply rejection ratio (PSRR) and a specified output noise voltage density without requiring a discrete capacitor coupled to the output node external to an integrated circuit comprising the first and second integrated LDO regulators.

19. The method of claim 15, wherein the specified frequency range extends from about 10 kilohertz (kHz) to about 10 megahertz (MHz).

* * * * *